United States Patent [19]

Kahn

[11] 4,421,348

[45] Dec. 20, 1983

[54] DOOR GUARD

[76] Inventor: Robert S. Kahn, 220 San Vicente Blvd., Santa Monica, Calif. 90402

[21] Appl. No.: 323,301

[22] Filed: Nov. 20, 1981

Related U.S. Application Data

[63] Continuation of Ser. No. 44,717, Jun. 1, 1979, abandoned.

[51] Int. Cl.[3] ..... E05C 19/18

[52] U.S. Cl. ..... 292/339; 292/DIG. 15

[58] Field of Search ..... 292/343, 339, 263, 338, 292/162, DIG. 15, DIG. 49

[56] References Cited

U.S. PATENT DOCUMENTS

| | | | |
|---|---|---|---|
| 904,304 | 11/1908 | Bulger | 292/339 X |
| 1,054,151 | 2/1913 | Troetel | 292/338 |
| 1,334,399 | 3/1920 | Porter | 292/339 |
| 1,571,024 | 1/1926 | Scheid | 292/162 |
| 1,606,149 | 11/1926 | Crewson | 292/338 |
| 1,918,129 | 7/1933 | Phillips | 292/338 |

FOREIGN PATENT DOCUMENTS

| | | | |
|---|---|---|---|
| 20983 | of 1907 | United Kingdom | 292/DIG. 49 |

*Primary Examiner*—Richard E. Moore
*Attorney, Agent, or Firm*—Thomas J. Greer, Jr.

[57] ABSTRACT

A door guard which is readily engaged with a door, the door swinging about a vertical axis above a floor. The door guard is simply formed of three members, one member for engaging the door, one member for anchoring against the floor and an intermediate locking member, all of which are pivotally connected to one another and swingable to form a rigid triangle including the door and the floor with the locking member and the floor anchoring member forming a diagonal leg of that triangle to prevent the swinging of the door about its hinges.

1 Claim, 3 Drawing Figures

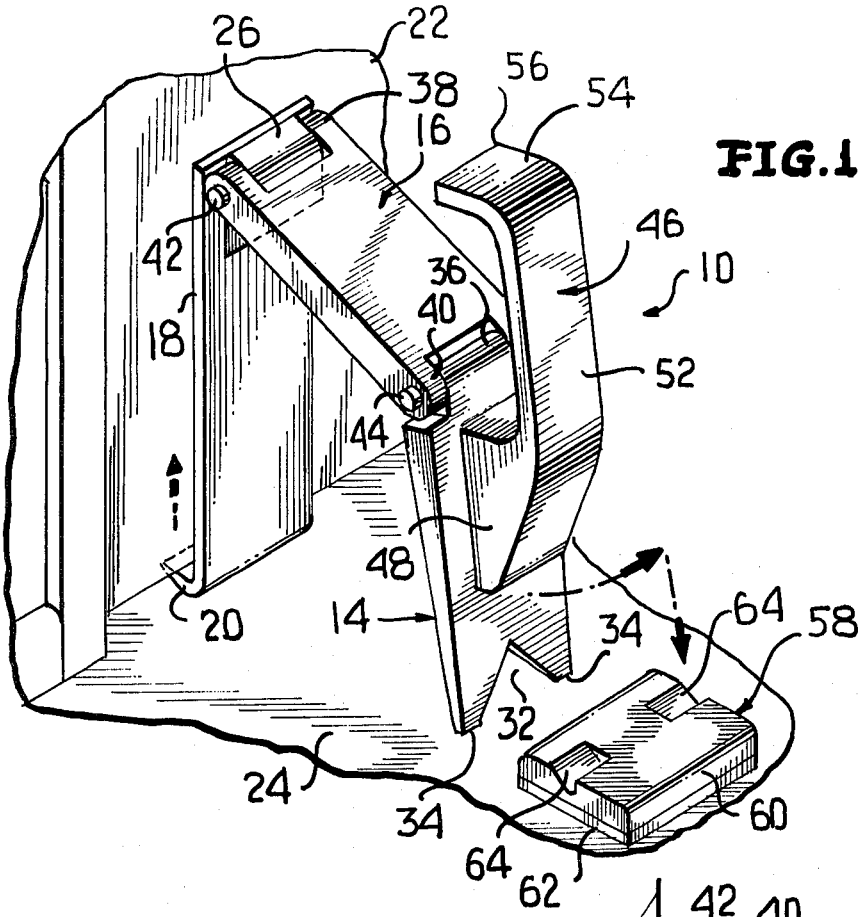
FIG.1
FIG.2
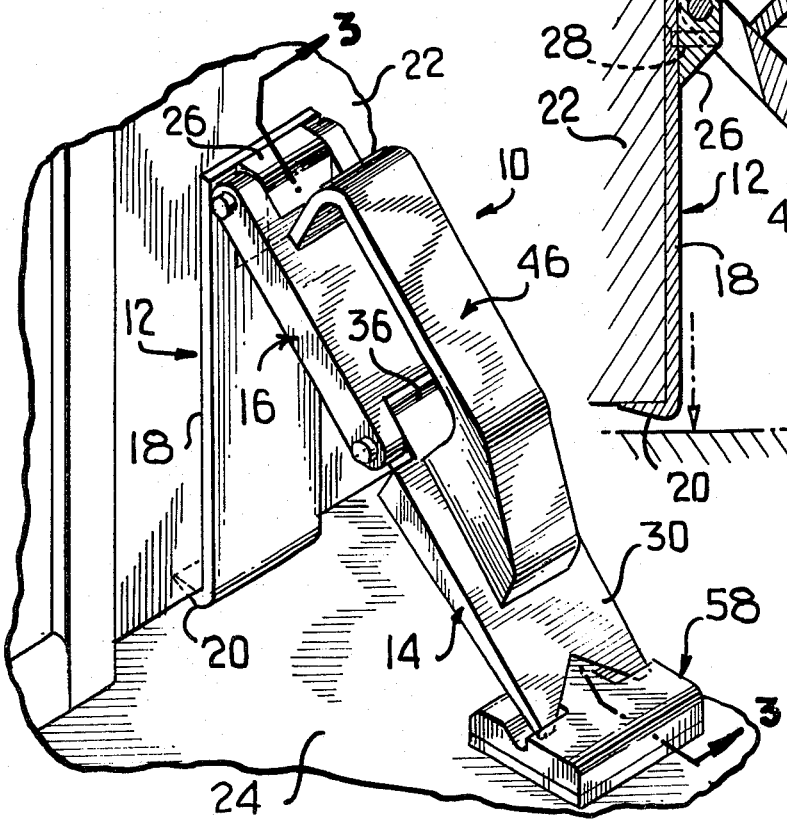
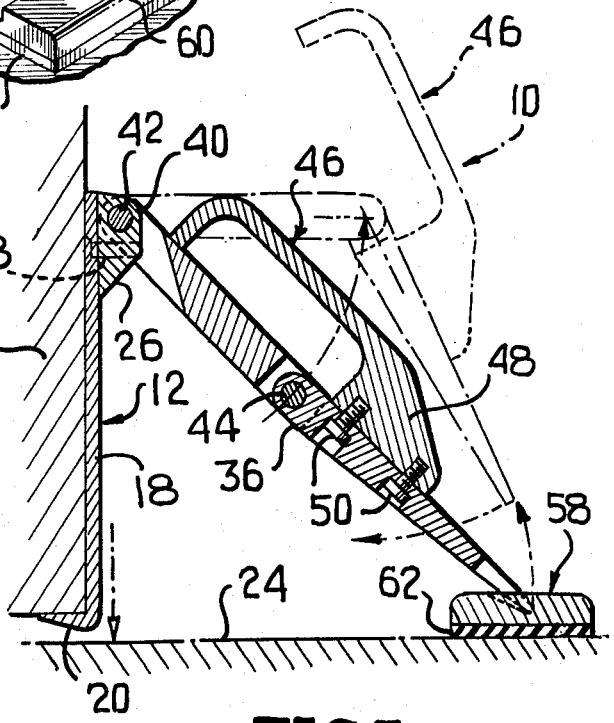
FIG.3

DOOR GUARD

This is a continuation of application Ser. No. 44,717 filed June 1, 1979 now abandoned.

This invention relates in general to new and useful improvements in door latching mechanisms, and more particularly to a guard which may be engaged with a lower portion of a door and wedge relative to the adjacent floor for holding the door in a closed position.

While conventional door locks provide normal adequate protection against entry, it is well known that in most instances the door jamb carrying the latch pin receiving plate is of insufficient strength to prevent entry if one desires to apply adequate force. In order to prevent such forceable entry, it is proposed in accordance with this invention to provide a suitable guard which would engage a lower portion of a door and which will firmly anchor against the adjacent floor portion to prevent forceful entry.

This invention most particularly has to do with a portable guard which may be utilized in conjunction with all doors which are mounted for swinging movement and may also be used to prevent entry through doors which do not have locks.

Door guards of the general type to which this invention relates have been developed in the past. However, this invention relates to a very simple three piece device wherein the three pieces are pivoted together utilizing simple pivots and wherein two of the pieces define a brace-like member when they are moved into alignment with one another.

Most particularly, the two pieces of the door guard of this invention define a straight line brace between the top part of a door engaging member and the adjacent floor and are provided with stop means which retain them in their straight line position under load. The stop means are preferably in the form of a simple U-shape handle which is anchored to one of the two members and has the opposite end thereof engageable with the other of the members to function as a stop element.

In accordance with this invention, the floor engaging member may have a chisel shaped lower edge so that it may be selectively engaged directly with a rug covering a floor or with a pad which is fixedly engaged with the floor. Additionally, the chisel shaped edge may be bifurcated both to facilitate the anchoring thereof in a rug and interlocking with the pad.

IN THE DRAWINGS

With the above, and other objects in view that will hereinafter appear, the nature of the invention will be more clearly understood by reference to the following detailed description, the appended claims and the several views illustrated in the accompanying drawings.

FIG. 1 is a perspective view showing the door guard being positioned for holding a door in a closed position.

FIG. 2 is a perspective view similar to FIG. 1 and shows the door guard in position.

FIG. 3 is a vertical sectional view taken generally along the line 3—3 of FIG. 2 through the center of the door guard and shows the constructional details thereof, the door guard being shown in its released position in phantom lines.

The door guard is identified in the drawings by the reference numeral 10 and includes a door engaging member, generally identified by the numeral 12; a floor anchoring member, generally identified by the numeral 14, and an intermediate locking member, generally identified by the numeral 16. These three members are pivotally connected together by suitable pivot means as will be described in detail hereinafter.

The door engaging member 12 is in the form of a hook and includes an upstanding leg 18 and a lower flange 20. The flange 20, as is best shown in FIG. 3, is of a wedge shape configuration and joins the leg 18 generally at right angles thereto. By making the flange 20 wedge shape, it will be seen that the flange may be readily positioned between the bottom of a door 22 and an adjacent floor 24. The wedge shape configuration is particularly helpful when the floor 24 is covered by a rug and the door engages that rug.

The leg 18 is provided on the outer face thereof adjacent the upper end with an adapter or lug 26 which may either be formed integrally therewith or secured thereto by means of suitable fasteners 28 (FIG. 3). It is to be noted that the lug 26 is of a lesser width than both the door engaging member 12 and the locking member 16.

The floor engaging member 14 may be in the form of an elongated wedge shape leg 30 which has the lower end thereof notched as at 32 to define a pair of terminal prongs 34. These prongs 34 may be directly engaged in a rug, if the floor 24 is covered with a rug, or may be associated with an anchoring pad to be described hereinafter. The upper end of the leg 30 is of a reduced width to define a lug 36. It is to be understood that the lug 36 preferably is of the same width as the lug 26.

The locking member 16 is in the form of a buckle and has bifurcated ends 38 and 40. The bifurcated end 38 is engaged of the lug 26 pivotally connected thereto by a pivot pin 42. In a like manner, the bifurcated end 40 is engaged over the lug 36 and pivotally connected thereto by a pivot pin 44.

In order to actuate the door guard, the floor anchoring member 14 is provided with a handle which is generally identified by the numeral 46. The handle 46 is generally U-shape in cross-section, as is best shown in FIG. 3. The handle 46 includes a mounting end 48 which is relatively wide and which receives suitable fasteners 50 carried by the leg 30 to fixedly secure the handle 46 thereto.

The handle 46 also includes a grip portion 52 which extends generally parallel to the leg 30. A grip portion 52 terminates in a second end portion 54 which has a free end surface 56 disposed coplanar with a like surface of the end portion 48.

If desired, the door guard may also include an anchoring pad, generally identified by the numeral 58. The anchoring pad is preferably in the form of a simple rectangular plate 60 having bonded on the underside thereof a friction material, such as rubber 62, which will prevent it from sliding along a floor. In order to facilitate the interlocking of the floor anchoring member 14 with the anchoring pad, the plate 60 has formed on the upper surface thereof two transversely spaced and aligned notches or seats 64 for receiving the prongs 34.

OPERATION

With the door 22 closed, the anchoring pad, when used, is positioned on the floor 24 a prescribed distance from the door. The door engaging member 12 is then engaged with the door, generally in the position shown. The lower end of the floor anchoring member 14 is then engaged with the anchoring pad 58. At this time the locking member 16 and the floor anchoring member 14 are pivoted relative to one another. The handle 46 is then depressed, increasing the spacing between the upper end of the door engaging member 12 and the lower end of the floor anchoring member 14 causing a wedging action between the floor and the door. This is continued until the locking member 16 and the floor anchoring member 14 assume a straight line position at which time a free end surface 56 of the handle 46 engages the locking member 16. At this time the locking member 16 and the floor anchoring 14 have assumed a straight line position as shown in FIGS. 2 and 3 with the combined locking member 16 and floor engaging member 14 defining a rigid third leg of a triangular relationship best shown in FIG. 3 thereby preventing movement of the door 22 towards an open position.

At this time it is pointed out that the handle 46 may be configurated so as to permit a slight over center movement of the locking member 16 and the floor anchoring member 14 so as to assure the latching operation. It is also to be understood that, if desired, the handle 46 may be mounted on the locking member 16 and engage the floor anchoring member 14 as a stop.

When it is desired to disengage the door guard 10, one merely grips the handle 46 and pulls upwardly thereon so as to effect movement of the locking member 16 and the floor anchoring member 14 out of their straight line or slightly over center relationship.

It is believed that the simplicity of the door guard 10 and the manner in which it operates will be readily apparent from the illustrations in the drawings.

It will be understood that the anchoring pad 58 need not be employed if desired. Namely, the ends of prongs 34 may directly engage the floor 24, or a floor covering thereon, or a rubber cup, whose up standing walls surround the two prongs 34.

It is claimed:

1. A door guard for holding a swinging door in a closed position; said door guard comprising three members including a door engaging member, a floor anchoring member and a locking member, first pivot means connecting said locking member to said door engaging member in angular relation and second pivot means pivotally connecting said floor anchoring member to said locking member in end to end relation, and cooperating means on said floor anchoring member and locking member for limited pivoting thereof to a straight line aligned coplanar relationship wherein said floor anchoring member and said locking member form a rigid arrangement, said cooperating means being in the form of a generally U-shaped handle having one end fixedly anchored to a selected one of said floor anchoring member and said locking member and a second end forming a stop for engaging an intermediate portion the other of said floor engaging member and said locking member when said floor engaging member and said locking member are in said straight line aligned coplanar relationship, said floor engaging member having a generally wedge shaped free end, said wedge shaped free end being bifurcated to define two spaced apart prongs, and an anchoring pad having a friction base for frictionally engaging the floor, and said anchoring pad having separate seats for separately receiving said prongs.

* * * * *